US012503298B2

(12) United States Patent
Risser et al.

(10) Patent No.: US 12,503,298 B2
(45) Date of Patent: Dec. 23, 2025

(54) BEVERAGE PAD AND APPARATUS FOR MAKING BEVERAGE PADS

(71) Applicant: Koninklijke Douwe Egberts B.V., Utrecht (NL)

(72) Inventors: Jules Risser, Utrecht (NL); Hermanus Cornelius Jozef Elbertse, Vreeswijk (NL); Daniel Thomas Ahearn, Otley (GB); Duncan James Wales, Holbeach (GB)

(73) Assignee: Koninklijke Douwe Egberts B.V., Utrecht (NL)

( * ) Notice: Subject to any disclaimer, the term of this patent is extended or adjusted under 35 U.S.C. 154(b) by 340 days.

(21) Appl. No.: 18/266,573

(22) PCT Filed: Dec. 13, 2021

(86) PCT No.: PCT/NL2021/050760

§ 371 (c)(1),
(2) Date: Jun. 9, 2023

(87) PCT Pub. No.: WO2022/124902

PCT Pub. Date: Jun. 16, 2022

(65) Prior Publication Data

US 2024/0043200 A1 Feb. 8, 2024

(30) Foreign Application Priority Data

Dec. 11, 2020 (EP) ..... 20213576

(51) Int. Cl.
*B65D 85/804* (2006.01)
*B65B 9/04* (2006.01)
*B65B 29/02* (2006.01)

(52) U.S. Cl.
CPC ..... *B65D 85/8046* (2013.01); *B65B 9/042* (2013.01); *B65B 29/025* (2017.08); *B65B 2009/047* (2013.01)

(58) Field of Classification Search
CPC ... B65D 85/8046; B65B 29/025; B65B 9/042; B65B 2009/047
See application file for complete search history.

(56) References Cited

U.S. PATENT DOCUMENTS 3,813,848 A * 6/1974 Romagnoli ..... B65B 29/028 53/546
4,437,294 A * 3/1984 Romagnoli ..... B65B 1/366 53/553

(Continued)

FOREIGN PATENT DOCUMENTS

CN 2397041 9/2000
CN 2730758 10/2005

(Continued)

OTHER PUBLICATIONS

International Search Report and Written Opinion date of mailing Feb. 3, 2023, International Application No. PCT/NL2021/050760, 18 pgs.

*Primary Examiner* — Joshua G Kotis
*Assistant Examiner* — Scott A Howell
(74) *Attorney, Agent, or Firm* — Fitch, Even, Tabin & Flannery LLP

(57) ABSTRACT

An apparatus for making a beverage pad having an amount of extractable or soluble beverage preparation product as a compacted puck enclosed between two sheets of filtering material comprises dosing means arranged for supply of a dose of extractable or soluble beverage preparation product to a puck forming device of the apparatus and further comprises a packaging device arranged to package a compacted puck received from the puck forming device between two sheets of filtering material to form the beverage pad. The puck forming device comprises a cylindrical rotating drum with an outer side surface having recesses for receiving in each recess a dose of extractable or soluble beverage preparation product. A bottom wall of each recess is formed by a movable piston arranged to move with respect to the outer side surface of the drum to vary a height of the recess in relation to an angular position of the recess on the circular circumference of the drum. The puck forming device further comprises a compression body adjacent to the rotating drum arranged to provide a counter surface to compress a dose of extractable or soluble beverage preparation product against. The compression body comprises drive means arranged to drive the counter surface moving along a circumferential part of the outer side surface of the rotating drum with a (Continued)

velocity corresponding to a velocity of the outer side surface of the rotating drum.

13 Claims, 4 Drawing Sheets

(56) References Cited

U.S. PATENT DOCUMENTS

| | | | | |
|---|---|---|---|---|
| 7,559,185 | B2 * | 7/2009 | Conti | B65B 47/04 53/523 |
| 7,661,248 | B2 * | 2/2010 | Conti | B65B 37/20 53/529 |
| 9,352,859 | B2 * | 5/2016 | Librio | B65B 29/025 |
| 10,273,027 | B2 * | 4/2019 | Kepinski | B65B 55/24 |
| 11,877,583 | B2 * | 1/2024 | Lyzenga | B65B 25/08 |
| 2011/0016834 | A1 * | 1/2011 | Rapparini | B65B 29/022 53/510 |

FOREIGN PATENT DOCUMENTS

| | | |
|---|---|---|
| CN | 106697363 | 5/2017 |
| EP | 0915014 | 5/1999 |
| EP | 2573008 | 3/2013 |
| WO | 2005012099 | 2/2005 |
| WO | 2005056386 | 6/2005 |
| WO | 2012035473 | 3/2012 |
| WO | 2016020822 | 2/2016 |

* cited by examiner

BEVERAGE PAD AND APPARATUS FOR MAKING BEVERAGE PADS

CROSS REFERENCE TO RELATED APPLICATIONS

This application is a U.S. national phase application of International Application No. PCT/NL2021/050760, filed Dec. 13, 2021, which claims benefit from European Application 20213576.0, filed Dec. 11, 2020, which are each hereby incorporated herein by reference in their entirety.

FIELD OF THE INVENTION

The invention relates to a beverage pad. The invention further relates to an apparatus for making beverage pads. Moreover the invention relates to a puck forming device for use in an apparatus for making beverage pads. The invention also relates to a packaging device for use in an apparatus for making beverage pads and further relates to dosing means for use in an apparatus for making beverage pads.

BACKGROUND

Beverage pads are well known consumption articles that may be used in a beverage preparation machine for preparing a consumable beverage such as a coffee, tea, chocolate or milk based beverage. Usually a beverage pad comprises an amount of extractable or soluble beverage preparation product enclosed between two sheets of filtering material, which allows a beverage to be prepared by supplying the pad in the beverage preparation machine with an aqueous fluid to extract or solubilize the beverage preparation product. For example a coffee beverage may be prepared from a beverage pad comprising an amount of extractable coffee product, e.g. ground coffee, between two sheets of filtering material. Such pads are known to comprise the beverage product either held between the two sheets in a relatively loose form, for instance for preparing an American-style or brewed coffee beverage, or held in a compacted form between the two sheets, for instance to allow also for preparation of other sorts of coffee beverages, e.g. espresso-style coffee beverages such as espresso's, cappuccino's and latte macchiato's.

In the latter case, the beverage product in compacted form may be provided by compressing the beverage product prior to packaging between the two sheets. This compressing of the beverage product to provide the beverage product in compacted form, i.e. a puck, is realized in a known apparatus for making beverage pads by a puck forming device which comprises a rotating cylindrical drum with an outer side surface having recesses for receiving in each recess a dose of extractable or soluble beverage preparation product. In the drum a bottom wall of each recess is formed by a respective movable piston that is arranged to move with respect to the outer side surface of the drum in order to vary a height of the recess in dependence of an angular position of the recess on the circular circumference of the drum. A compression wall, usually formed by a metal plate, is arranged adjacent to the rotating drum outer side surface to provide a counter surface against which a dose of extractable or soluble beverage preparation product in a recess in the rotating drum may be compressed by movement of the respective piston when in the rotation of the drum the recess is positioned at an angular position opposite the counter surface. Upon further rotation of the drum the dose of extractable or soluble beverage preparation product is then moved past the counter surface and released from the recess in compacted form as a puck to be packaged between two sheets of filtering material in a packaging device of the known apparatus to form the beverage pad.

The known apparatus for making beverage pads has as a drawback that for adequate compressing of the beverage product to form a compacted puck a necessary compressing force provides relatively high friction between the opposing surfaces of the rotating drum with beverage product and the compression wall. In use of the apparatus this affects a maximum rotational speed with which the rotating drum can be operated, resulting in a relatively low production rate of pucks and as such beverage pads with the known apparatus, and may affect a quality, in particular consistency of quality, of the pucks being formed.

Accordingly, an aim of the present invention is to provide an apparatus that ameliorates the drawback of the known apparatus for making beverage pads. A particular aim of the invention is to provide an apparatus that allows for preparing beverage pads comprising a compacted puck of extractable or soluble beverage preparation product with good and consistent quality at high production rates. Another aim of the invention is to provide a high quality beverage pad. A further aim of the present invention is to provide a packaging device for an apparatus for making a beverage pad. In particular, it is an aim of the present invention to provide a packaging device for an apparatus for making beverage pads that allows for packaging of a compacted puck to form a beverage pad of good quality.

DESCRIPTION OF THE INVENTION

According to a first aspect there is provided a puck forming device for use in an apparatus for making beverage pads, each pad having an amount of extractable or soluble beverage preparation product as a compacted puck enclosed between two sheets of filtering material, which pads are useable in a beverage preparation machine for preparing a beverage by supplying the pad in the machine with an aqueous fluid under pressure to extract or solubilize the beverage preparation product, the puck forming device arranged to compact a dose of beverage preparation product in the compacted puck and to deliver the compacted puck to a packaging device of the apparatus for enclosing the compacted puck between two sheets of filtering material to form the beverage pad, wherein the puck forming device comprises a cylindrical rotating drum with an outer side surface having one or more recesses for receiving in each of the one or more recesses a dose of extractable or soluble beverage preparation product, a bottom wall of each of the one or more recesses formed by a respective movable piston arranged to move with respect to the outer side surface of the drum to vary a height of the recess in relation to an angular position of the recess on the circular circumference of the drum and a compression body adjacent to the rotating drum arranged to provide a counter surface for a dose of extractable or soluble beverage preparation product in a recess in the rotating drum positioned at an angular position opposite the counter surface to be compressed against, against which counter surface the dose of extractable or soluble beverage preparation product is compressible by the respective piston of the recess to form the compacted puck, wherein the compression body comprises drive means arranged to drive the counter surface moving opposite a circumferential part of the outer side surface of the rotating drum with a velocity corresponding to a velocity of the circumferential part of the outer side surface of the rotating drum. By moving the counter surface of the compression body and the opposing circumferential part of the outer side surface of the rotating drum with the same velocity there is little to no relative movement between these surfaces resulting in low friction during compression of a dose of extractable or soluble beverage preparation product against the counter surface. The counter surface of the compression body may be driven by the drive means to move opposite the circumferential part of the outer side surface of the rotating drum in a same direction with a speed at least almost the same as a tangential speed of the outer side surface of the rotating drum, i.e. with the same velocity. Thus, the counter surface may be driven to move synchronously with the rotating drum. Because of the low friction a relative high rotational speed of the rotating drum is possible allowing the puck forming device to produce pucks with good and consistent quality at high production rates. In an aspect of the puck forming device the dose of extractable or soluble beverage preparation product may be compacted such that the resulting puck is configured and arranged to at least substantially maintain its shape with uniform thickness in use in the beverage pad in the beverage preparation machine when exposed to the aqueous fluid under pressure. For example the puck may be produced by the puck forming device with a compaction force of between 2-8 kN, preferably between 3-6 kN, most preferably at least almost 4 kN. It will be understood that a desired compressive pressure for producing the puck may be predetermined and selected in dependence on the actual beverage preparation product. A compressive force of at least 2 kN is found to provide a sturdiness to the produced puck sufficient to maintain a uniform thickness of the puck in use of the beverage pad. Above 6 kN compressive pressure the compaction of the beverage preparation product results in a puck that when used in a beverage preparation machines forms such a high flow resistance to the supplied fluid that the pad in some of the available beverage preparation machines may be practically unusable due to unacceptable long preparation times and/or prepared beverage characteristics being less than desired such as the occurrence of over extraction resulting in for example bitter flavors and aromas.

After compression of the dose of extractable or soluble beverage preparation product the counter surface may move in a direction away from the rotating drum to enable the formed puck to be released from the recess. The release may be solely by gravity, e.g. by moving the recess to an angular position on the circular circumference of the drum facing downwards, and/or may be affected by a further movement of the respective piston thereby pushing the puck out of the recess.

Preferably the rotating drum of the puck forming device has more than one recess, i.e. multiple recesses, in the outer surface so as to increase a puck production rate of the puck forming device given a rotational speed of the rotating drum. For example the rotating drum may comprise a series of two or more approximately identical recesses on the circular circumference of the drum and/or comprise a series of two or more approximately identical recesses distributed over the outer surface in an axial direction of the drum. Preferably the recesses are evenly distributed over the circular circumference of the drum, i.e. an angular distance between consecutive recesses in a series of recesses on the circular circumference is at least approximately the same.

The compression body of the puck forming device may have the counter surface sized to fully cover at least one recess of the rotating drum in order to allow for evenly compressing of a dose of extractable or soluble beverage preparation product in said recess against the counter surface. The counter surface may be sized to cover simultaneously multiple recesses of the rotating drum when moved along a circumferential part of the outer side surface of the rotating drum. For example the counter surface may extent in the axial direction of the drum to simultaneously cover multiple recesses of a series of recesses distributed over the outer side surface in the axial direction of the drum. The counter surface accordingly allows simultaneous compression of multiple doses of extractable or soluble beverage preparation product for each recess in a series of recesses distributed over the outer side surface in the axial direction of the drum at a given angular position on the circumference of the rotating drum opposite the counter surface.

The compression body may additionally or instead comprise separate body sections each section arranged to move along a circumferential part of the outer side surface of the rotating drum comprising at least one recess to define a respective counter surface opposite said at least one recess. For example in an embodiment of the puck forming device the compression body comprises a sequence of links, wherein at least one link of the sequence of links provides the counter surface. The sequence of links may be driven by the drive means of the compression body to move with a speed in dependence on a rotational speed of the rotating drum so as to move during rotation of the rotating drum at least the at least one link as counter surface opposite the circumferential part of the outer side surface of the rotating drum comprising the at least one recess with a velocity corresponding to a velocity of said circumferential part. Upon further rotation of the rotating drum preferably a successive link of the at least one link in the sequence of links is moved as counter surface opposite a successive circumferential part of the outer side surface of the rotating drum comprising a successive recess so as to provide a continuous compressing system.

The at least one link may comprise an outer surface acting at least in part as counter surface which outer surface may extent to cover one recess of the rotating drum or cover multiple recesses of the rotating drum simultaneously. For example a length of the outer surface of the link may be arranged to simultaneously cover two or more consecutive recesses on the circular circumference of the rotating drum when moved along a circumferential part of the outer side surface of the rotating drum. For example a width of the outer surface of the link may be arranged to simultaneously cover two or more consecutive recesses of a series of recesses distributed over the outer side surface in the axial direction of the drum. Additionally, or alternatively, a further sequence of links may be provided in the compression body to provide at least one further link which comprises an outer surface acting as counter surface which outer surface may extent to cover one further recess of the rotating drum or cover multiple further recesses of the rotating drum simultaneously. The sequence of links and further sequence of links may be driven independently or, preferably, driven simultaneously, e.g. by the same drive means. For example the drive means may comprise a rotation axis, e.g. a rotatable shaft, to which both the sequence of links and further sequence of links are coupled at respective parts of the axis. Upon rotation of the rotation axis both the sequence of links and further sequence of links, which may be parallel to each other, are simultaneously driven with the same rotational speed. The axis may be arranged to be driven in rotation with a rotation speed that moves the sequence of links and further sequence of links such that a speed of the counter surface of each sequence of links opposite the respective circumferential part of the outer side surface of the rotating drum is at least almost the same as the tangential speed of the outer side surface of the rotating drum.

In an embodiment of the puck forming device the links adjacent the at least one link defining the counter surface are at least partially positioned in near proximity, or in operative contact, with the outer side surface of the rotating drum. For example a preceding link in the sequence of links, preceding the at least one link, and a successive link in the sequence of links, succeeding the at least one link, are positioned with at least part of their respective outer surfaces opposite a preceding and successive circumferential part of the outer side surface of the rotating drum respectively when the at least one link is positioned with the outer surface opposite the circumferential part of the outer side surface of the rotating drum comprising the at least one recess to form the counter surface. Such positioning of the compression body and the outer side surface of the rotating drum ensures particularly at relatively high rotation speeds of the drum a correct alignment of the counter surface opposite the at least one recess and supports a reliable and even compression of a dose of extractable or soluble beverage preparation product to form a high quality puck.

Preferably at least a section of the sequence of links, e.g. a section comprising or consisting of the at least one link and its adjacent links, is arranged to move opposite the circumferential part of the outer side surface of the rotating drum comprising the at least one recess. Particularly the links in said section of the sequence of links together define an outer section surface, by mutual positioning of consecutive links, having a concave curvature corresponding to a curvature of a convex outer side surface of the rotating drum. For example in an embodiment the links in the sequence of links are coupled to each other in a closed loop, particularly as metalique slates coupled to a continuous rotating chain, in particular a caterpillar track. The continuous rotating chain, and in particular a caterpillar track, may provide an infinite counter surface when driven in rotation with a speed similar to the rotation speed of the rotating drum. The number of links in the continuous rotating chain or caterpillar track is preferably such that a total outer surface length of the chain or track is at least sufficient to act as counter surface for all recesses on the circular circumference of the drum. As the counter surface is preferably driven to move with a velocity at least almost the same as the velocity of the opposing circumferential part of the outer side surface of the rotating drum, it is preferred that the total outer surface length of the chain or track is at least almost the same as the circumference of the rotating drum. In that case both the rotating drum and the chain or track may be conveniently driven with a same frequency, i.e. one complete rotation of the drum equals one complete rotation of the chain or track.

A section of the loop or caterpillar track that is positioned opposite the outer side surface of the rotating drum may be arranged to follow a curved path defining a section outer surface with a concave curvature corresponding to a convex curvature of the outer side surface of the rotating drum when the loop or caterpillar track is being driven to move in rotation. For example the section may be formed by the at least one link and its adjacent links, wherein the links within the section are mutually angled to define the curved section outer surface.

In an embodiment the at least one link, and preferably each link, has a concave outer surface with a curvature corresponding to a curvature of a convex outer side surface of the rotating drum. As such the outer surface of the at least one link acting as counter surface can be brought in near proximity of the outer side surface rotating drum with a distance between said two surfaces being equal over a complete surface area. Because of the corresponding curvatures an arranged distance, i.e. gap, between the surfaces further does not change in use of the device. Alternatively or in addition a counter surface section of the outer surface of the at least one link may be approximately flat, i.e. not curved, so as to provide the puck with a flat surface.

In a second aspect there is provided an apparatus for making beverage pads, each pad having an amount of extractable or soluble beverage preparation product as a compacted puck enclosed between two sheets of filtering material, which pads are useable in a beverage preparation machine for preparing a beverage by supplying the pad in the machine with an aqueous fluid under pressure to extract or solubilize the beverage preparation product, wherein the apparatus comprises:

- dosing means arranged for supply of a dose of extractable or soluble beverage preparation product to a puck forming device;
- a puck forming device; and
- a packaging device arranged to package a compacted puck received from the puck forming device between two sheets of filtering material to form the beverage pad, wherein the puck forming device is in accordance with the first aspect described herein.

In an embodiment the apparatus for making beverage pads has the packaging device comprising a rotating cylindrical body, e.g. a further rotating drum, with an outer side surface having recesses for receiving in each recess a first sheet of filtering material, a bottom wall of each recess formed by a respective movable piston arranged to move with respect to the outer side surface of the cylindrical body to vary a height of the recess in relation to an angular position of the recess on the circular circumference of the cylindrical body. For example the packaging device can be arranged below the rotating drum of the puck forming device to directly receive pucks formed by the puck forming device on the first sheet of filtering material in each recess of the further rotating drum. To this end the cylindrical body is preferably arranged to be driven with a rotational speed adapted to the rotational speed of the rotating drum of the puck forming device such that each puck formed in and provided by the puck forming device is received in a corresponding recess of the cylindrical body. For example the rotating drum and cylindrical body may have a corresponding outer surface circumference with corresponding number of recesses and both may be driven to have the same rotational speed. The rotating drum and cylindrical body may instead differ in outer surface circumference, e.g. the cylindrical body may have a larger circumference at the outer surface, and amount of recesses, e.g. the cylindrical body may have a larger number of recesses on the circular circumference than the rotating drum. The movable piston of each recess may be used to release a packaged puck from the respective recess, e.g. the piston pushes the packaged puck out of the recess by moving the piston from a retracted position to a position closer to the outer surface of the cylindrical body.

Preferably the packaging device of the apparatus for making beverage pads comprises a filtering material feed station for feeding a first continuous sheet of filtering material to the rotating cylindrical body with impressions being provided in the continuous sheet of filtering material in a respective recess of the cylindrical body to receive in each impression a compacted puck of beverage preparation product delivered by the puck forming device.

In known packaging of compacted pucks between two sheets of filtering material to form a pad the first sheet is usually shaped with an impression to form a pouch-like bottom portion, side portion and an edge portion defining a space for receiving the compacted puck. A second sheet of filtering material may be applied over the compacted puck opposite the bottom wall to cover the beverage product on both sides to form the beverage pad, e.g. by sealing the second sheet to the edge portion of the first sheet. The shaping of the first sheet is usually realized either by suction of a piece of the filtering material in a recess, e.g. by using suction means, or by pressing a piece of the filtering material in a recess, e.g. by running a belt with protrusions along the further rotating drum with the piece of the first sheet enclosed between drum and belt. In practice elastic properties of the filtering material together with stretch applied to the material upon suction or pressing of the piece of the sheet in the recess results in both these methods that the first sheet is shaped with the pouch-like form having a sloped or curved transition between the bottom portion and side portion, i.e. an angle between bottom portion and side portion in the shaped first sheet is not straight or 90°, due to elastic deformation of the filtering material upon removal of the suction or pressing force. As a consequence the known beverage pads produced have a rounded or sloped transition between the bottom and side with the pad having a non-uniform thickness, i.e. a thickness of the pad and the puck at a side portion of the pad is less than a thickness of the pad and puck at a central portion of the pad. Such non-uniform thickness of pad and particularly puck may affect the beverage quality of the beverage prepared. Particularly for pads comprising an extractable beverage product, for example ground coffee, the non-uniform thickness may cause bypass when supplying an aqueous fluid through the pad. As a consequence consistency of extraction between pads may be less than desired, and the extraction may not be optimal.

To improve the packaging in this regard a preferred embodiment of the apparatus for making beverage pads has the movable piston of each recess in the cylindrical body arranged to be driven to move in dependence of its angular position on the circular circumference of the cylindrical body between a first state defining a first height of the respective recess for receiving the first sheet of filtering material in the respective recess with an impression having a corresponding height dimension which is larger than a thickness of each compacted puck of beverage preparation product delivered by the puck forming device, and a second state defining a second height of the respective recess smaller than the first height for forming the first sheet of filtering material in the respective recess with an impression shaped to approximately match a shape of each compacted puck of beverage preparation product. Thus the apparatus is configured to receive a piece of the first sheet in the recess with the first height, which height compared to a thickness of the puck formed by the puck forming device is over dimensioned, and configured to provide said piece of first sheet with an impression shaped to approximately match a shape of each compacted puck of beverage preparation product by moving the piston in the second state. The reduction of the height of the recess after initially over dimensioning the piece of the first sheet in the recess may be adapted to compensate for any elastic deformation of the piece of the first sheet, thus allowing for shaping the piece of the first sheet with bottom portion and side portion being angled straight or 90°. Accordingly the apparatus enables preparing pads with uniform thickness by packaging a compacted puck with uniform thickness between such piece of the first sheet and a second sheet.

In a particular embodiment of the apparatus for making beverage pads the filtering material feed station comprises a continuous running belt provided with protrusions arranged to form an impression in the first sheet of filtering material with a height dimension which is larger than a thickness of each compacted puck of beverage preparation product by pressing the first sheet of filtering material in a respective recess in the cylindrical body when the corresponding movable piston is in the first state.

In an embodiment of the apparatus for making beverage pads the packaging device comprises a further filtering material feed station for feeding a second continuous sheet of filtering material over the first continuous sheet of filtering material enclosing the compacted puck between the continuous sheets and to cut the continuous sheets to form the beverage pad with a compacted puck enclosed between the two sheets of filtering material.

An embodiment of the apparatus for making beverage pads has the dosing means comprising a container with a product chamber for holding an amount of extractable or soluble beverage preparation product and an outlet opening for dispensing doses of extractable or soluble beverage preparation product to the puck forming device.

The container may be any suitable type of container with any suitable chamber volume for dispensing doses of extractable or soluble beverage preparation product at a speed matching the speed of the puck forming device. However, in a preferred embodiment of the apparatus for making beverage pads the container comprises a dosing funnel.

In an embodiment of the apparatus for making beverage pads the dosing means comprise a feeder in the product chamber of the container arranged to feed a dose of extractable or soluble beverage preparation product to the outlet opening of the container for dispensing to the puck forming device. The feeder, e.g. belt feeder, rotating feeder or roll feeder, may particularly be configured to assist in delivering extractable or soluble beverage preparation product to the outlet opening of the container in an amount corresponding to a single dose to be supplied to the puck forming device.

In a preferred embodiment the apparatus for making beverage pads has the feeder comprising a screw feeder. A screw feeder is particularly suited for relatively high speed dosing and supplying of product as multiple separate doses may be simultaneously moved towards the container outlet opening by configuring the used helical screw blade or spiral blade of the screw feeder.

An embodiment of the apparatus for making beverage pads has the dosing means comprising a scrambler unit in the product chamber of the container arranged to scramble or stir the extractable or soluble beverage preparation product. The scrambler unit reduces or prevents undesired clumping, e.g. agglomerating, of particularly powder-like beverage substances such as ground coffee in the container, and thereby maintains a correct dosing of the beverage substance.

In a preferred embodiment of the apparatus for making beverage pads the scrambler unit comprises a rotating screw.

In a third aspect there is provided a packaging device for use in an apparatus for making beverage pads, each pad having an amount of extractable or soluble beverage preparation product as a compacted puck enclosed between two sheets of filtering material, which pads are useable in a beverage preparation machine for preparing a beverage by supplying the pad in the machine with an aqueous fluid under pressure to extract or solubilize the beverage preparation product, the packaging device arranged to package a compacted puck received from a puck forming device of the apparatus between two sheets of filtering material to form the beverage pad, wherein the packaging device comprises a rotating cylindrical body with an outer side surface having recesses for receiving in each recess a first sheet of filtering material, a bottom wall of each recess formed by a respective movable piston arranged to move with respect to the outer side surface of the cylindrical body to vary a height of the recess in relation to an angular position of the recess on the circular circumference of the cylindrical body.

In an embodiment the packaging device comprises a filtering material feed station for feeding a first continuous sheet of filtering material to the rotating cylindrical body with impressions being provided in the continuous sheet of filtering material in a respective recess of the cylindrical body to receive in each impression a compacted puck of beverage preparation product delivered by the puck forming device of the apparatus.

In an embodiment the packaging device has the movable piston of each recess in the cylindrical body arranged to be driven to move in dependence of its angular position on the circular circumference of the cylindrical body between a first state defining a first height of the respective recess for receiving the first sheet of filtering material in the respective recess with an impression having a corresponding height dimension which is larger than a thickness of each compacted puck of beverage preparation product delivered by the puck forming device, and a second state defining a second height of the respective recess smaller than the first height for forming the first sheet of filtering material in the respective recess with an impression shaped to approximately match a shape of each compacted puck of beverage preparation product.

In an embodiment of the packaging device the filtering material feed station comprises a continuous running belt provided with protrusions arranged to form an impression in the first sheet of filtering material with a height dimension which is larger than a thickness of each compacted puck of beverage preparation product by pressing the first sheet of filtering material in a respective recess in the cylindrical body when the corresponding movable piston is in the first state.

In an embodiment the packaging device comprises a further filtering material feed station for feeding a second continuous sheet of filtering material over the first continuous sheet of filtering material enclosing the compacted puck between the continuous sheets and to cut the continuous sheets to form the beverage pads with a compacted puck enclosed between two sheets of filtering material.

In a fourth aspect there is provided an apparatus for making beverage pads, each pad having an amount of extractable or soluble beverage preparation product as a compacted puck enclosed between two sheets of filtering material, which pads are useable in a beverage preparation machine for preparing a beverage by supplying the pad in the machine with an aqueous fluid under pressure to extract or solubilize the beverage preparation product, wherein the apparatus comprises:

dosing means arranged for supply of a dose of extractable or soluble beverage preparation product to a puck forming device;

a puck forming device; and a packaging device arranged to package a compacted puck received from the puck forming device between two sheets of filtering material to form the beverage pad, wherein the packaging device is in accordance with the third aspect described herein.

In a fifth aspect there is provided a dosing means for use in an apparatus for making beverage pads, each pad having an amount of extractable or soluble beverage preparation product as a compacted puck enclosed between two sheets of filtering material, which pads are useable in a beverage preparation machine for preparing a beverage by supplying the pad in the machine with an aqueous fluid under pressure to extract or solubilize the beverage preparation product, the dosing means arranged for supply of a dose of extractable or soluble beverage preparation product to a puck forming device of the apparatus, the dosing means comprising a container with a product chamber for holding an amount of extractable or soluble beverage preparation product and an outlet opening for dispensing doses of extractable or soluble beverage preparation product to the puck forming device, wherein the dosing means comprise a feeder in the product chamber of the container arranged to feed a dose of extractable or soluble beverage preparation product to the outlet opening of the container for dispensing to the puck forming device.

In an embodiment of the dosing means the container comprises or consists of a dosing funnel.

A particular embodiment of the dosing means has the feeder comprising or consisting of a screw feeder.

Another embodiment of the dosing means comprises a scrambler unit in the product chamber of the container arranged to scramble or stir the extractable or soluble beverage preparation product. Preferably the scrambler unit comprises a rotating screw.

In a sixth aspect there is provided apparatus for making beverage pads, each pad having an amount of extractable or soluble beverage preparation product as a compacted puck enclosed between two sheets of filtering material, which pads are useable in a beverage preparation machine for preparing a beverage by supplying the pad in the machine with an aqueous fluid under pressure to extract or solubilize the beverage preparation product, wherein the apparatus comprises:

dosing means arranged for supply of a dose of extractable or soluble beverage preparation product to a puck forming device;

a puck forming device; and a packaging device arranged to package a compacted puck received from the puck forming device between two sheets of filtering material to form the beverage pad, wherein the dosing means is in accordance with the fifth aspect described herein.

In a seventh aspect there is provided a beverage pad for use in a beverage preparation machine for preparing a beverage by supplying the pad in the machine with an aqueous fluid under pressure, comprising an amount of extractable or soluble beverage preparation product as a compacted puck enclosed tightly between two sheets of filtering material sealed to each other at a periphery edge, a first sheet of the two sheets having a bottom portion, side portion and an edge portion, a second sheet of the two sheets being a substantially flat piece of filtering material having a central portion and an edge portion, the edge portions of the sheets sealed to each other forming the periphery edge of the pad, and the side portion, bottom portion and central portion defining a space holding the compacted puck of extractable or soluble beverage preparation, wherein the compacted puck enclosed between the two sheets has a uniform thickness with the bottom portion and central portion being parallel to each other on opposite sides of the compacted puck, and the side portion extending perpendicular between the bottom portion and central portion around the compacted puck. The pad has a uniform thickness which improves a consistency of beverage quality, as well as may improve the beverage quality, particularly with respect to extraction characteristics, when used for preparing a beverage as occurrence of bypass when supplying an aqueous fluid through the pad is minimized or completely prevented.

In a preferred embodiment the compacted puck for use in the beverage pad comprises an amount of extractable and/or soluble beverage preparation product in a layer, wherein the puck has one or more of the following features:

- the layer comprises 6.5 to 7.5 g ground coffee, preferably 7 g;
- the ground coffee has a moisture content of 3 to 5%, preferably 4.5%;
- the layer comprises or mainly consists of ground coffee grinds with a grind size (×50) between 250-500 μm, preferably between 300-360 μm or between 430-470 μm, optionally comprising an amount of fines of at most 20% of the total amount of grinds;
- a bulk density of between 350-450 g/L, preferably a bulk density between 390-405 g/L or 365-390 g/L, preferably 375-385 g/L or 395-400 g/L;
- a uniform thickness of between 6-7.5 mm, preferably 6.5-7.2 mm, most preferably approximately 6.8 mm; and
- is shaped as a circular disc with a diameter of between 50-60 mm, preferably 55 mm.

BRIEF DESCRIPTION OF THE FIGURES

These and other aspects of the present invention are hereinafter further elucidated by the appended drawing and the corresponding embodiments, which form part of the present application. The drawing is not in any way meant to reflect a limitation of the scope of the invention, unless this is clearly and explicitly indicated. In the drawing.

In this application similar or corresponding features are denoted by similar or corresponding reference signs. The description of the embodiments is not limited to the examples shown in the figures and the reference numbers used in the detailed description and the claims are not intended to limit the description of the embodiments, but are included to elucidate the embodiments by referring to the examples shown in the figures.

DETAILED DESCRIPTION OF THE FIGURES

Figure 1:
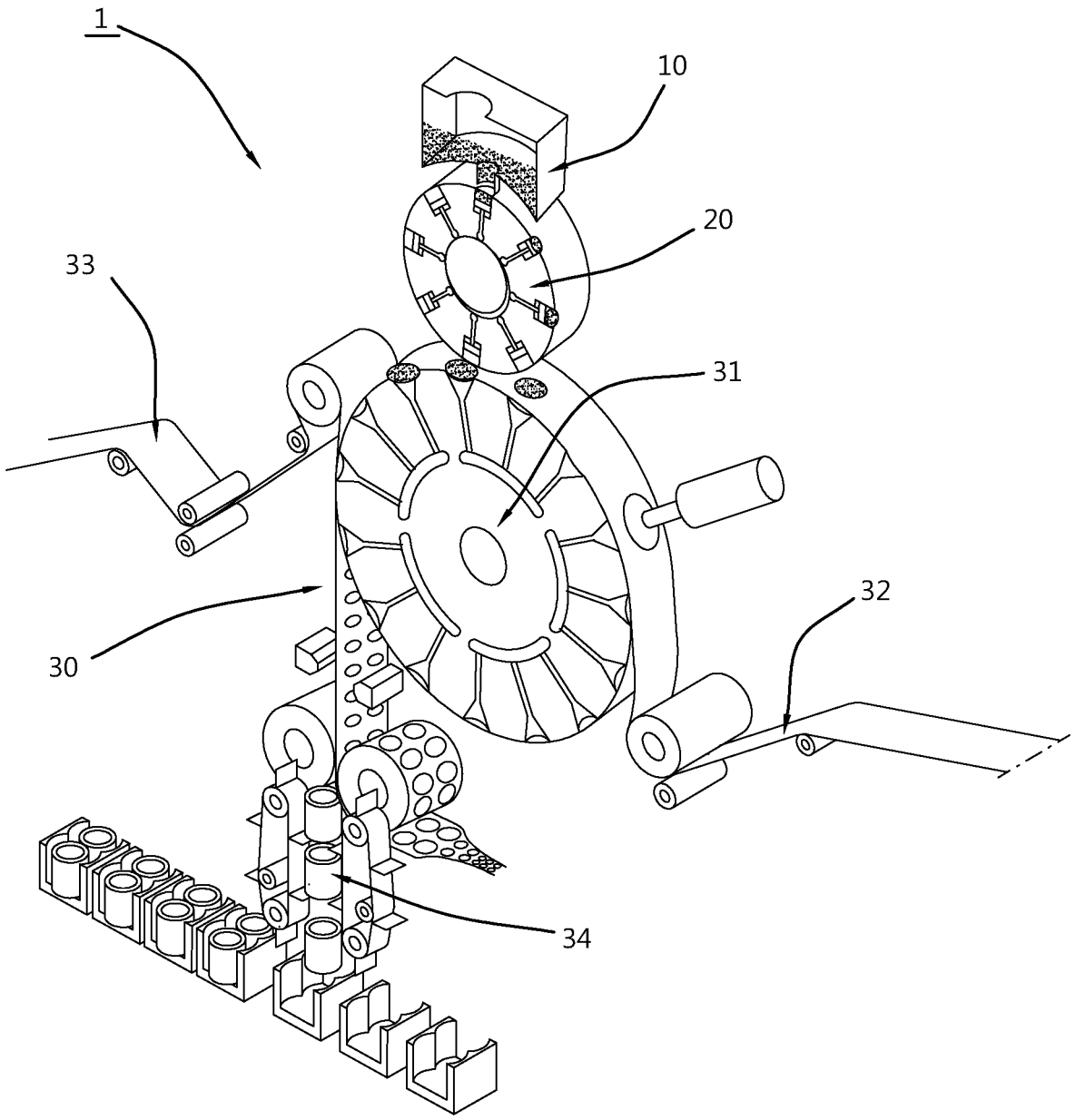
FIG. 1 shows a schematic perspective view of a known apparatus for making beverage pads.

As shown in FIG. 1 a known apparatus 1 for making beverage pads comprises a dosing means 10 having a container with a product chamber for holding an amount of extractable or soluble beverage preparation product and an outlet opening for dispensing doses of extractable or soluble beverage preparation product to a puck forming device 20 of the apparatus. The puck forming device 20 is arranged to compact a dose of beverage preparation product received from the dosing means 10 in a compacted puck with a compaction force ranging between 1000-6000N and the compacted puck having a circular disc like shape with diameter between 40-55 mm, preferably approximately 50 mm, and with a uniform thickness between 3-8 mm, preferably approximately 7 mm. The puck forming device 20 is further arranged to deliver the compacted puck to a packaging device 30 of the apparatus for enclosing the compacted puck between two sheets of filtering material to form the beverage pad. To this end the puck forming device 20 comprises a rotating cylindrical drum with an outer side surface having recesses for receiving in each recess a dose of extractable or soluble beverage preparation product. In the drum a bottom wall of each recess is formed by a respective movable piston that is arranged to move with respect to the outer side surface of the drum in order to vary a height of the recess in dependence of an angular position of the recess on the circular circumference of the drum. In the known apparatus a compression wall (not shown), usually formed by a metal plate, may be arranged adjacent to the rotating drum outer side surface to provide a counter surface against which a dose of extractable or soluble beverage preparation product in a recess in the rotating drum may be compressed by movement of the respective piston when in the rotation of the drum the recess is positioned at an angular position opposite the counter surface. Upon further rotation of the drum the dose of extractable or soluble beverage preparation product is moved past the counter surface and released from the recess in compacted form as a puck to be packaged between two sheets of filtering material in the packaging device 30 of the known apparatus to form the beverage pad. The packaging device 30 comprises a rotating cylindrical body 31, particularly a further rotating drum, with an outer side surface having recesses for receiving in each recess a first sheet of filtering material supplied by a filtering material feed station 32 for feeding a first continuous sheet of filtering material over the outer side surface of the rotating cylindrical body. The packaging device 30 comprises a further filtering material feed station 33 for feeding a second continuous sheet of filtering material over the first continuous sheet of filtering material enclosing the compacted puck between the continuous sheets. In an aspect the packaging device 30 may comprise heating means (not shown) to bond the sheets of filtering material together by heat treatment of the sheets, e.g. heat welding. Other means of boding the two sheets together may also or alternatively be applied, such as glue to adhere the sheets to each other. The packaging device 30 also comprises means 34 to cut the continuous sheets to form individual beverage pads with a compacted puck enclosed between two sheets of filtering material and to supply the beverage pads into suitable packages.

Figure 2:
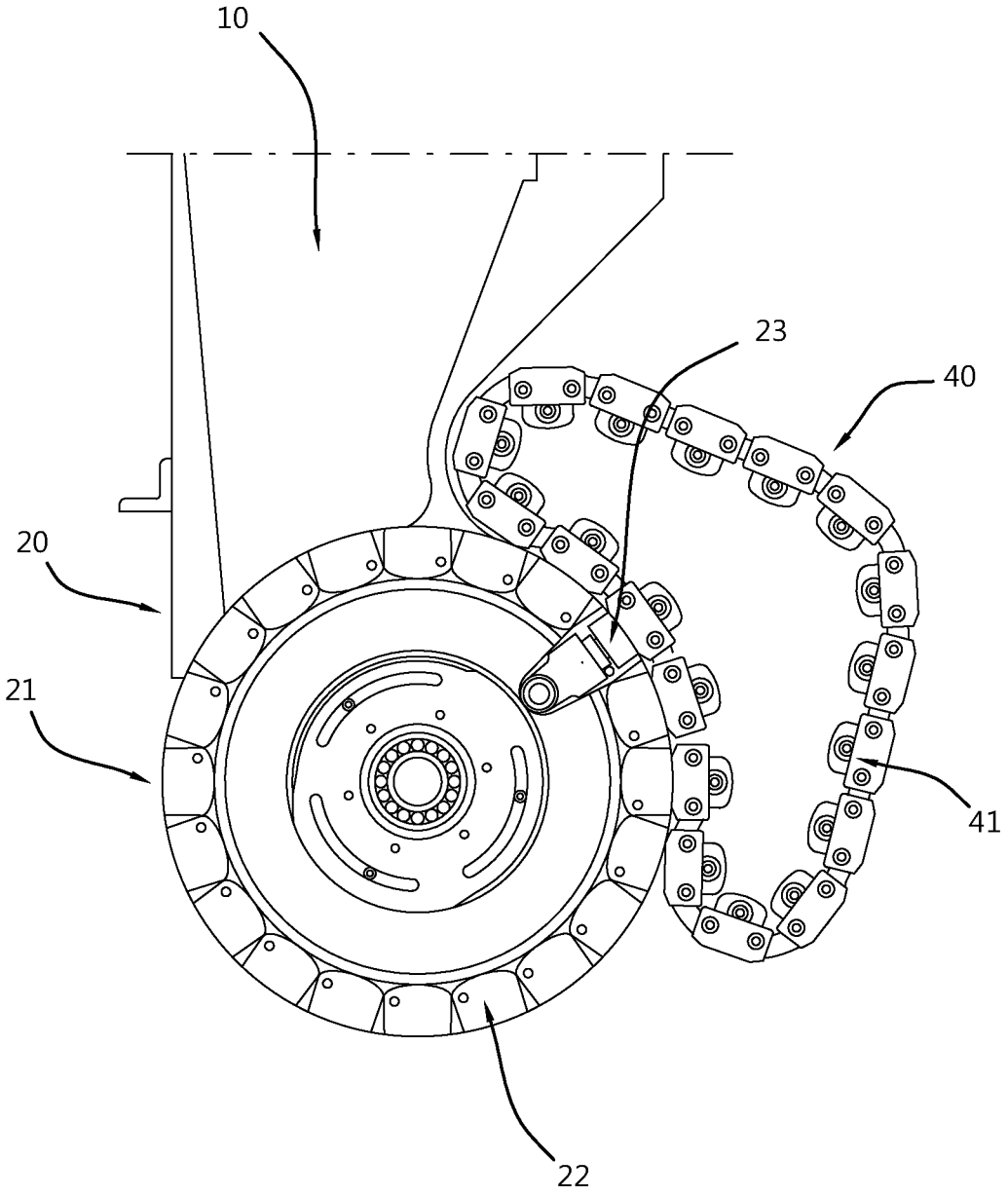
FIG. 2 shows a detailed cross sectional partial view of an embodiment of a puck forming device according to the first aspect described herein.
Figure 3:
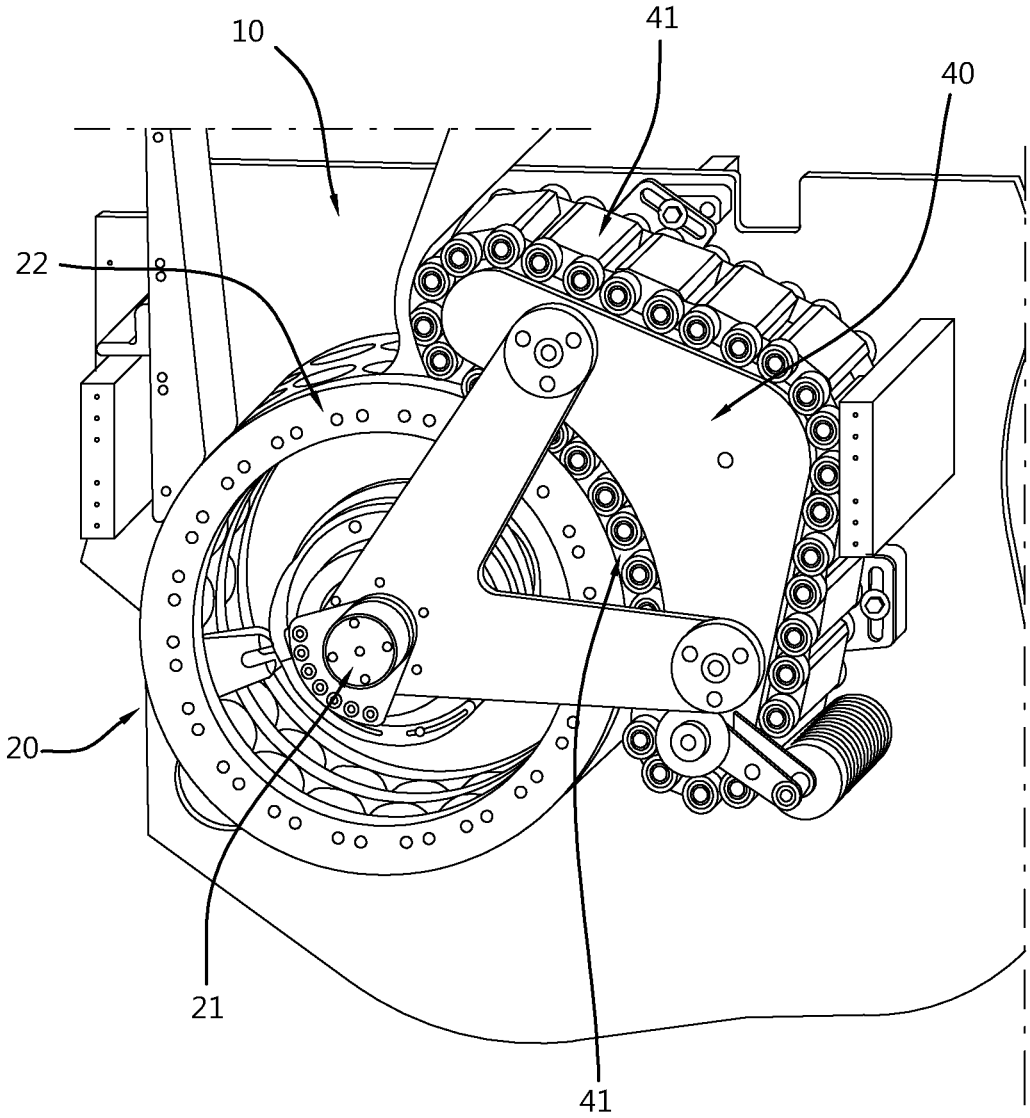
FIG. 3 shows a perspective view of the embodiment of the puck forming device according to FIG. 2.

FIG. 2 and FIG. 3 show an improved embodiment of a puck forming device 20 which is in accordance with the first aspect described herein together with an embodiment of a dosing means 10. The puck forming device 20 is particularly configured for use in an apparatus for making beverage pads according to the second aspect described herein. The puck forming device 20 comprises a cylindrical rotating drum 21 of which an outer side surface is generally smooth but with recesses 22 for receiving in each recess a dose of extractable or soluble beverage preparation product from the dosing means 10. A bottom wall of each recess 22 is formed by a respective movable piston 23 that is arranged to move with respect to the outer side surface of the drum to vary a height of the recess in relation to an angular position of the recess on the circular circumference of the drum. In this embodiment the rotating drum 21 has two series of recesses evenly distributed along the circular circumference of the drum, the series being parallel to each other in an axial direction of the drum.

As shown the puck forming device 20 further comprises a compression body 40 adjacent to the rotating drum 21, the compression body providing a counter surface against which the dose of extractable or soluble beverage preparation product in a recess is compressible by moving the respective piston of said recess. The compression body 40 comprises a caterpillar-like continuous rotating chain with interconnected links 41, i.e. metalique slates, forming a closed loop. In use, each link 41 may act with its outer surface as counter surface for a dose of extractable or soluble beverage preparation product to be compressed against by rotating the chain synchronously with the rotating drum. In this embodiment each link is sized to cover one recess of each of the two series of recesses simultaneously, i.e. a length of the link extending in the axial direction of the drum is sized to simultaneously cover two parallel recesses whereas a width of the link is sized to cover one recess of the recesses in a series of recesses extending along the circular circumference of the drum when acting as counter surface. The links accordingly allow simultaneous compression of two doses of extractable or soluble beverage preparation product.

The compression body 40 is shaped to have a section of the continuous rotating chain positioned adjacent to the outer side surface of the rotating drum wherein a plurality of links moving in that section follow a curved path such that outer surfaces of the plurality of links in that section define a section outer surface with a concave curvature corresponding to a convex curvature of the outer side surface of the rotating drum. Furthermore each link 41 has a concave outer surface with a curvature corresponding to a curvature of a convex outer side surface of the rotating drum. Because of the corresponding curvatures the compression body and rotating drum can be positioned adjacent each other in close proximity, with an arranged distance, i.e. gap, between their respective surfaces being arranged for a suitable and desired compression of the dose of extractable or soluble beverage preparation product in each recess of the rotating drum.

In order to allow for compression of the dose of extractable or soluble beverage preparation product against the counter surface at relative high rotational speeds with minimal friction, the rotating drum 21 and the compression body 40 are both driven by drive means which are arranged, e.g. programmed, to move the continuous rotating chain along a circumferential part of the outer side surface of the rotating drum with a velocity corresponding to a velocity of the outer side surface of the rotating drum. As such the puck forming device 20 is an improvement for the know apparatus for making beverage pads, in that because of the low friction between the synchronously moving opposing surfaces compacted pucks of extractable or soluble beverage preparation product can be produced with good and consistent quality at high production rates.

A further improvement of the know apparatus for making pads can be made by using as a packaging device 30 a packaging device in accordance with the third aspect described herein and/or by using as a dosing means 10 a dosing means in accordance with the fifth aspect described herein. Particularly the packaging device in accordance with the third aspect described herein and the apparatus for making pads in accordance with the second, fourth or sixth aspect described herein allow for making an improved beverage pad in accordance with the seventh aspect described herein.

Figure 4A:
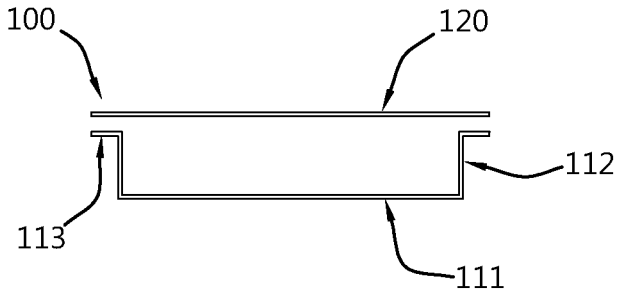
FIG. 4*a,b,c* shows a schematic representation of a beverage pad according to the seventh aspect described herein, with respectively showing a) exploded view of the pad with a first sheet of material and second sheet of material separate from each other, b) side view of the pad with first sheet of material and second sheet of material sealed to each other, c) bottom view of the pad.
Figure 4B:
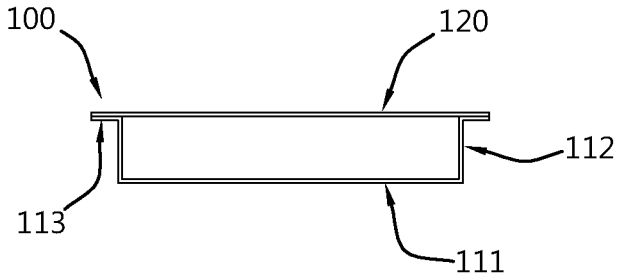
Figure 4C:
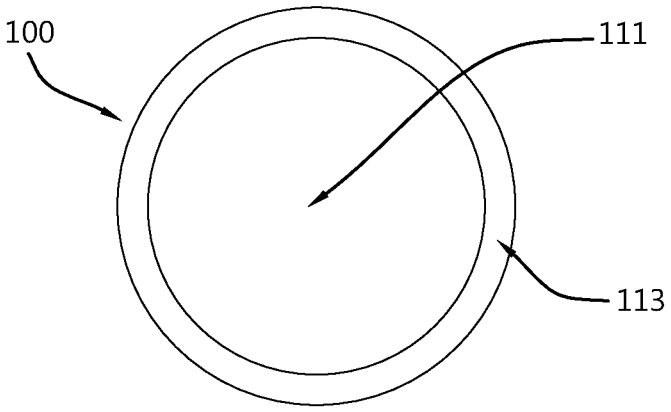

As shown in FIG. 4*a,b,c* such beverage pad 100 in accordance with the seventh aspect described herein comprises a first sheet of filtering material 110 shaped to have a bottom portion 111, side portion 112 and an edge portion 113. The beverage pad 100 further comprises a substantially flat piece of a second sheet of filtering material 120 having a central portion 121 and an edge portion 122. The bottom portion 111, side portion 112, and central portion 121 define and delimit a space holding a compacted puck 130 of extractable or soluble beverage preparation product. The compacted puck 130 has a uniform thickness and is tightly enclosed between the two sheets 110,120 which are sealed to each other at the edge portions 113, 122 with the bottom portion 111 and central portion 121 being parallel to each other on opposite sides of the compacted puck 130. The side portion 112 extends perpendicular between the bottom portion 111 and central portion 121 around the compacted puck 130, with an angle between the bottom portion 111 and side portion 112 being straight. The beverage pad 100 when used to prepare a beverage provides a consistent and high beverage quality, as occurrence of bypass through the puck when supplying an aqueous fluid through the pad is minimized or completely prevented.

Unless otherwise defined, all technical and scientific terms used herein have the same meaning as commonly understood by one of ordinary skill in the art to which this invention belongs. Methods and materials are described herein for use in the present invention. However other suitable methods and materials known in the art can also be used. The materials and examples are illustrative only and not intended to be limiting, unless so indicated. For the purpose of clarity and a concise description, features are described herein as part of the same or separate aspects and preferred embodiments thereof, however, it will be appreciated that the scope of the invention may include embodiments having combinations of all or some of the features described. In the description above, it will be understood that when an element such as layer, region or substrate is referred to as being "on" or "onto" another element, the element is either directly on the other element, or intervening elements may also be present. Also, it will be understood that the values given in the description above, are given by way of example and that other values may be possible and/or may be strived for.

Furthermore, the invention may also be embodied with less components than provided in the embodiments described here, wherein one component carries out multiple functions. Just as well may the invention be embodied using more elements than depicted in the Figures, wherein functions carried out by one component in the embodiment provided are distributed over multiple components.

It is to be noted that the figures are only schematic representations of embodiments of the invention that are given by way of non-limiting examples.

For the purpose of clarity and a concise description, features are described herein as part of the same or separate embodiments, however, it will be appreciated that the scope of the invention may include embodiments having combinations of all or some of the features described.

The word 'comprising' does not exclude the presence of other features or steps than those listed in a claim. It also does not exclude that nothing else is present, i.e. it may also encompass the meaning of 'consisting of'. Furthermore, the words 'a' and 'an' shall not be construed as limited to 'only one', but instead are used to mean 'at least one', and do not exclude a plurality.

A person skilled in the art will readily appreciate that various parameters and values thereof disclosed in the description may be modified and that various embodiments disclosed and/or claimed may be combined without departing from the scope of the invention.

The invention claimed is:

1. A puck forming device for use in an apparatus for making beverage pads, each pad having an amount of extractable or soluble beverage preparation product as a compacted puck enclosed between two sheets of filtering material, wherein the pads are useable in a beverage preparation machine for preparing a beverage by supplying the pad in the machine with an aqueous fluid under pressure to extract or solubilize the beverage preparation product, the puck forming device arranged to compact the dose of beverage preparation product in the compacted puck and to deliver the compacted puck to a packaging device of the apparatus for enclosing the compacted puck between two sheets of filtering material to form the beverage pad, wherein the puck forming device comprises:

a cylindrical rotating drum with an outer side surface having recesses for receiving in each recess the dose of extractable or soluble beverage preparation product, a bottom wall of each recess formed by a respective movable piston arranged to move with respect to the outer side surface of the drum to vary a height of the recess in relation to an angular position of the recess on the circular circumference of the drum; and a compression body adjacent to the rotating drum arranged to provide a counter surface for the dose of extractable or soluble beverage preparation product in the recess in the rotating drum positioned at an angular position opposite the counter surface to be compressed against, against which counter surface the dose of extractable or soluble beverage preparation product is compressible by the respective piston of the recess to form the compacted puck, wherein the compression body comprises drive means arranged to drive the counter surface moving along a circumferential part of the outer side surface of the rotating drum with a velocity corresponding to a velocity of the outer side surface of the rotating drum, wherein the compression body comprises a sequence of links, wherein at least one link of the sequence of links provides the counter surface, and wherein the links in the sequence of links are coupled to each other in a closed loop to form a continuous rotating chain.

2. The puck forming device according to claim 1, wherein links adjacent to the at least one link are at least partially in contact with the outer side surface of the rotating drum.

3. The puck forming device according to claim 1, wherein each link has a concave outer surface with a curvature corresponding to a curvature of the convex outer side surface of the rotating drum.

4. The puck forming device according to claim 1, wherein the drive means of the compression body are arranged to move the counter surface with a rotational speed corresponding to a rotational speed of the rotating drum.

5. The puck forming device according to claim 1, wherein the cylindrical rotating drum comprises at least two series of recesses, each series of recesses comprised of recesses equidistantly spaced on the circumference of the rotating drum, wherein the compression body extends with the counter surface over the recesses in each series positioned at an angular position opposite the counter surface.

6. The puck forming device according to claim 5, wherein the compression body comprises a separate sequence of links for each series of recesses, wherein each separate sequence of links has at least one link that provides the counter surface for the respective series of recesses.

7. An apparatus for making beverage pads, each pad having an amount of extractable or soluble beverage preparation product as a compacted puck enclosed between two sheets of filtering material, which pads are useable in a beverage preparation machine for preparing a beverage by supplying the pad in the machine with an aqueous fluid under pressure to extract or solubilize the beverage preparation product, wherein the apparatus comprises:

dosing means arranged for supply of a dose of extractable or soluble beverage preparation product to a puck forming device;

the puck forming device of claim 1; and a packaging device arranged to package the compacted puck received from the puck forming device between two sheets of filtering material to form the beverage pad.

8. The apparatus according to claim 7, wherein the packaging device comprises a rotating cylindrical body, with an outer side surface having recesses for receiving in each recess a first sheet of filtering material, a bottom wall of each recess formed by a respective movable piston arranged to move with respect to the outer side surface of the cylindrical body to vary a height of the recess in relation to an angular position of the recess on the circular circumference of the cylindrical body.

9. The apparatus according to claim 8, wherein the packaging device comprises a filtering material feed station for feeding the first continuous sheet of filtering material to the rotating cylindrical body with impressions being provided in the continuous sheet of filtering material in a respective recess of the cylindrical body to receive in each impression a compacted puck of beverage preparation product delivered by the puck forming device.

10. The apparatus according to claim 9, wherein the movable piston of each recess in the cylindrical body is driven to move in dependence of its angular position on the circular circumference of the cylindrical body between a first state defining a first height of the respective recess for receiving the first sheet of filtering material in the respective recess with an impression having a corresponding height dimension which is larger than a thickness of each compacted puck of beverage preparation product delivered by the puck forming device, and a second state defining a second height of the respective recess smaller than the first height for forming the first sheet of filtering material in the respective recess with an impression shaped to approximately match a shape of each compacted puck of beverage preparation product.

11. The apparatus according to claim 7, wherein the dosing means comprise a container with a product chamber for holding an amount of extractable or soluble beverage preparation product and an outlet opening for dispensing doses of extractable or soluble beverage preparation product to the puck forming device.

12. The apparatus according to claim 11, wherein the dosing means comprise a feeder in the product chamber of the container arranged to feed the dose of extractable or soluble beverage preparation product to the outlet opening of the container for dispensing to the puck forming device.

13. The apparatus according to claim 11, wherein the dosing means comprise a scrambler unit in the product chamber of the container arranged to scramble or stir the extractable or soluble beverage preparation product.

* * * * *